US006760457B1

(12) United States Patent
Bren et al.

(10) Patent No.: US 6,760,457 B1
(45) Date of Patent: Jul. 6, 2004

(54) AUTOMATIC TELEPHONE SWITCH FOR HEARING AID

(75) Inventors: Mark A. Bren, Lorretto, MN (US); Timothy S. Peterson, Lino Lakes, MN (US)

(73) Assignee: Micro Ear Technology, Inc., Plymouth, MN (US)

( * ) Notice: Subject to any disclaimer, the term of this patent is extended or adjusted under 35 U.S.C. 154(b) by 290 days.

(21) Appl. No.: 09/659,214

(22) Filed: Sep. 11, 2000

(51) Int. Cl.[7] ..... H04R 25/00
(52) U.S. Cl. ..... 381/331; 381/312
(58) Field of Search ..... 381/312, 322, 381/327, 328, 331; 379/52, 443–444; 361/103

(56) References Cited

U.S. PATENT DOCUMENTS

| | | | | |
|---|---|---|---|---|
| 2,530,621 A | | 11/1950 | Lybarger | 179/107 |
| 2,554,834 A | | 5/1951 | Lavery | 179/107 |
| 2,656,421 A | | 10/1953 | Lybarger | 179/107 |
| 3,396,245 A | | 8/1968 | Flygstad | 179/107 |
| 3,660,695 A | * | 5/1972 | Schmitt | 307/116 |
| 4,187,413 A | | 2/1980 | Moser | 179/107 |
| 4,467,145 A | | 8/1984 | Borstel | |
| 4,489,330 A | | 12/1984 | Marutake et al. | 343/742 |
| 4,490,585 A | * | 12/1984 | Tanaka | 379/52 |
| 4,508,940 A | | 4/1985 | Steeger | 179/107 |
| 4,596,899 A | | 6/1986 | Wojcik et al. | |
| 4,631,419 A | | 12/1986 | Sadamatsu et al. | 307/255 |
| 4,638,125 A | | 1/1987 | Buettner | 381/68.4 |
| 4,696,032 A | * | 9/1987 | Levy | 379/388.05 |
| 4,710,961 A | | 12/1987 | Buttner | 381/68.7 |
| 4,764,957 A | | 8/1988 | Angelini et al. | 379/433 |
| 4,845,755 A | | 7/1989 | Busch et al. | 381/68 |
| 4,862,509 A | | 8/1989 | Towsend | 381/163 |
| 4,887,299 A | | 12/1989 | Cummins et al. | 381/68.4 |
| 4,926,464 A | * | 5/1990 | Schley-May | 379/444 |
| 4,930,156 A | | 5/1990 | Norris | 379/388 |
| 5,010,575 A | * | 4/1991 | Marutake et al. | 379/443 |
| 5,027,410 A | | 6/1991 | Williamson et al. | |
| 5,086,464 A | | 2/1992 | Groppe | 379/430 |
| 5,091,952 A | | 2/1992 | Williamson et al. | |
| 5,189,704 A | | 2/1993 | Krauss | 381/68.4 |
| 5,212,827 A | | 5/1993 | Meszko et al. | 455/225 |
| 5,280,524 A | | 1/1994 | Norris | 379/387 |
| 5,404,407 A | | 4/1995 | Weiss | 381/68 |
| 5,422,628 A | * | 6/1995 | Rodgers | 200/61.45 R |
| 5,425,104 A | | 6/1995 | Shennib | 381/68 |
| 5,463,692 A | | 10/1995 | Fackler | 381/68 |
| 5,524,056 A | | 6/1996 | Killion et al. | 381/68.2 |
| 5,553,152 A | * | 9/1996 | Newton | 381/328 |
| 5,600,728 A | | 2/1997 | Satre | 381/68.2 |
| 5,636,285 A | | 6/1997 | Sauer | 381/68.2 |
| 5,640,293 A | * | 6/1997 | Dawes et al. | 361/103 |
| 5,640,457 A | | 6/1997 | Gnecco et al. | |
| 5,659,621 A | * | 8/1997 | Newton | 381/312 |
| 5,687,242 A | | 11/1997 | Iburg | |

(List continued on next page.)

FOREIGN PATENT DOCUMENTS

| | | | |
|---|---|---|---|
| DE | 3036417 | 5/1982 | H04R/25/00 |
| DE | 3443907 | 6/1985 | |
| FR | 2714561 | 6/1995 | |
| JP | 09-018998 | 1/1997 | H04R/25/02 |

OTHER PUBLICATIONS

Gilmore, R., "Telecoils: past, present & future", *Hearing Instruments, 44* (2), pp. 22, 26–27, 40, (1993).

(List continued on next page.)

*Primary Examiner*—Curtis Kuntz
*Assistant Examiner*—P. Dabney
(74) *Attorney, Agent, or Firm*—Schwegman, Lundberg, Woessner & Kluth, P.A.

(57) ABSTRACT

A hearing aid is provided with a switch that automatically switches the hearing aid input from a microphone input to a voice coil input in the presence of a magnetic field. The magnetic field can be generated by a magnet in a telephone handset.

13 Claims, 2 Drawing Sheets

U.S. PATENT DOCUMENTS

| | | | | |
|---|---|---|---|---|
| 5,706,351 | A | | 1/1998 | Weinfurtner ..... 381/68.2 |
| 5,710,820 | A | | 1/1998 | Martin et al. ..... 381/68.4 |
| 5,721,783 | A | | 2/1998 | Anderson ..... 381/328 |
| 5,737,430 | A | | 4/1998 | Widrow |
| 5,740,257 | A | | 4/1998 | Marcus |
| 5,751,820 | A | | 5/1998 | Taenzer ..... 381/68 |
| 5,757,932 | A | | 5/1998 | Lindemann et al. ..... 381/68 |
| 5,757,933 | A | * | 5/1998 | Preves et al. ..... 381/313 |
| 5,768,397 | A | | 6/1998 | Fazio ..... 381/68 |
| 5,796,848 | A | | 8/1998 | Martin ..... 381/68.2 |
| 5,809,151 | A | | 9/1998 | Husung ..... 381/69 |
| 5,991,419 | A | | 11/1999 | Brander ..... 381/312 |
| 5,991,420 | A | | 11/1999 | Stern ..... 381/315 |
| 6,031,922 | A | | 2/2000 | Tibbetts |
| 6,031,923 | A | | 2/2000 | Gnecco et al. |
| 6,078,675 | A | | 6/2000 | Bowen-Nielsen et al. .. 381/331 |
| 6,101,258 | A | | 8/2000 | Killion et al. |
| 6,104,821 | A | | 8/2000 | Husung ..... 381/312 |
| 6,115,478 | A | | 9/2000 | Schneider ..... 381/314 |
| 6,118,877 | A | | 9/2000 | Lindemann et al. ..... 381/60 |
| 6,148,087 | A | | 11/2000 | Martin ..... 381/327 |
| 6,157,727 | A | | 12/2000 | Rueda ..... 381/312 |
| 6,157,728 | A | | 12/2000 | Tong et al. |
| 6,175,633 | B1 | | 1/2001 | Morrill et al. ..... 381/71.6 |
| 6,310,556 | B1 | | 10/2001 | Green et al. ..... 340/636 |
| 6,324,291 | B1 | | 11/2001 | Weidner ..... 381/322 |
| 6,327,370 | B1 | | 12/2001 | Killion et al. |
| 6,356,741 | B1 | | 3/2002 | Bilotti et al. ..... 455/90 |
| 6,381,308 | B1 | | 4/2002 | Cargo et al. ..... 379/52 |
| 6,459,882 | B1 | | 10/2002 | Palermo et al. ..... 455/41 |
| 6,466,679 | B1 | | 10/2002 | Husung ..... 381/324 |

OTHER PUBLICATIONS

Preves, D.A., "A Look at the Telecoil—It's Development and Potential", *SHHH Journal,* pp. 7–10, (Sep./Oct. 1994).

Beck, L.B., "The "T" Switch; Some Tips for Effective Use", *Shhh,* (Jan./Feb. 1989), pp. 12–15.

Lybarger, S.F., "Development of a New Hearing Aid with Magnetic Microphone", *Electrical Manufacturing,* (Nov., 1947), 11 pages.

Hansaton Akustik GmbH, "48 K–AMP Contactmatic", (from Service Manual), (Apr. 1996), 8 pgs.

Schaefer, C., "Letter referencing Micro Ear Patent", (Aug. 22, 2002), 2 pgs.

* cited by examiner

AUTOMATIC TELEPHONE SWITCH FOR HEARING AID

FIELD OF THE INVENTION

This invention relates generally to hearing aids, and more particularly to an automatic switch for a hearing aid.

BACKGROUND

Hearing aids can provide adjustable operational modes or characteristics that improve the performance of the hearing aid for a specific person or in a specific environment. Some of the operational characteristics are volume control, tone control, and selective signal input. One way to control these characteristics is by a manually engagable switch on the hearing aid. As discussed in U.S. Pat. No. 5,757,933, it may be desirable to have both a non-directional microphone and a directional microphone in a single hearing aid. Thus, when a person is talking to someone in a crowded room the hearing aid can be switched to the directional microphone in an attempt to directionally focus the reception of the hearing aid and prevent amplification of unwanted sounds from the surrounding environment. However, the switch on the hearing aid in the '933 patent is a switch that must be operated by hand. It can be a drawback to require manual or mechanical operation of a switch to change the input or operational characteristics of a hearing aid. Moreover, manually engaging a switch in a hearing aid that is mounted within the ear canal is difficult, and may be impossible, for people with impaired finger dexterity.

In some known hearing aids, magnetically activated switches are controlled through the use of magnetic actuators, for examples see U.S. Pat. Nos. 5,553,152 and 5,659,621. The magnetic actuator is held adjacent the hearing aid and the magnetic switch changes the volume. However, such a hearing aid requires that a person have the magnetic actuator available when it desired to change the volume. Consequently, a person must carry an additional piece of equipment to control his/her hearing aid. Moreover, there are instances where a person may not have the magnetic actuator immediately present, for example when in the yard or around the house.

Once the actuator is located and placed adjacent the hearing aid, this type of circuitry for changing the volume must cycle through the volume to arrive at the desired setting. Such an action takes time and adequate time may not be available to cycle through the settings to arrive at the required setting, for example there may be insufficient time to arrive at the required volume when answering a telephone.

Some hearing aids have an input which receives the electromagnetic voice signal directly from the voice coil of a telephone instead of receiving the acoustic signal emanating from the telephone speaker. Accordingly, signal conversion steps, namely, from electromagnetic to acoustic and acoustic back to electromagnetic, are removed and a higher quality voice signal reproduction may be transmitted to the person wearing the hearing aid. It may be desirable to quickly switch the hearing aid from a microphone (acoustic) input to a coil (electromagnetic field) input when answering and talking on a telephone. However, quickly manually switching the input of the hearing aid from a microphone to a voice coil may be difficult for some hearing aid wearers.

SUMMARY OF THE INVENTION

Upon reading and understanding the present disclosure it is recognized that the inventive subject matter described herein satisfies the foregoing needs in the art and several other needs in the art not expressly noted herein. The following summary is provided to give the reader a brief summary which is not intended to be exhaustive or limiting and the scope of the invention is provided by the attached claims and the equivalents thereof.

One embodiment of the present invention provides a method and apparatus for switching of a hearing aid input between an acoustic input and an electromagnetic field input. In one embodiment a method and an apparatus are provided for automatically switching from acoustic input to electromagnetic field input in the presence of the telephone handset.

BRIEF DESCRIPTION OF THE DRAWINGS

A more complete understanding of the invention and its various features, objects and advantages may be obtained from a consideration of the following detailed description, the appended claims, and the attached drawings in which:

DETAILED DESCRIPTION

In the following detailed description, reference is made to the accompanying drawings which form a part hereof and in which is shown by way of illustration a specific embodiment in which the invention can be practiced. This embodiment is described in sufficient detail to enable those skilled in the art to practice and use the invention, and it is to be understood that other embodiments may be utilized and that electrical, logical, and structural changes may be made without departing from the spirit and scope of the present invention. The following detailed description is, therefore, not to be taken in a limiting sense and the scope of the present invention is defined by the appended claims and their equivalents.

Figure 1:
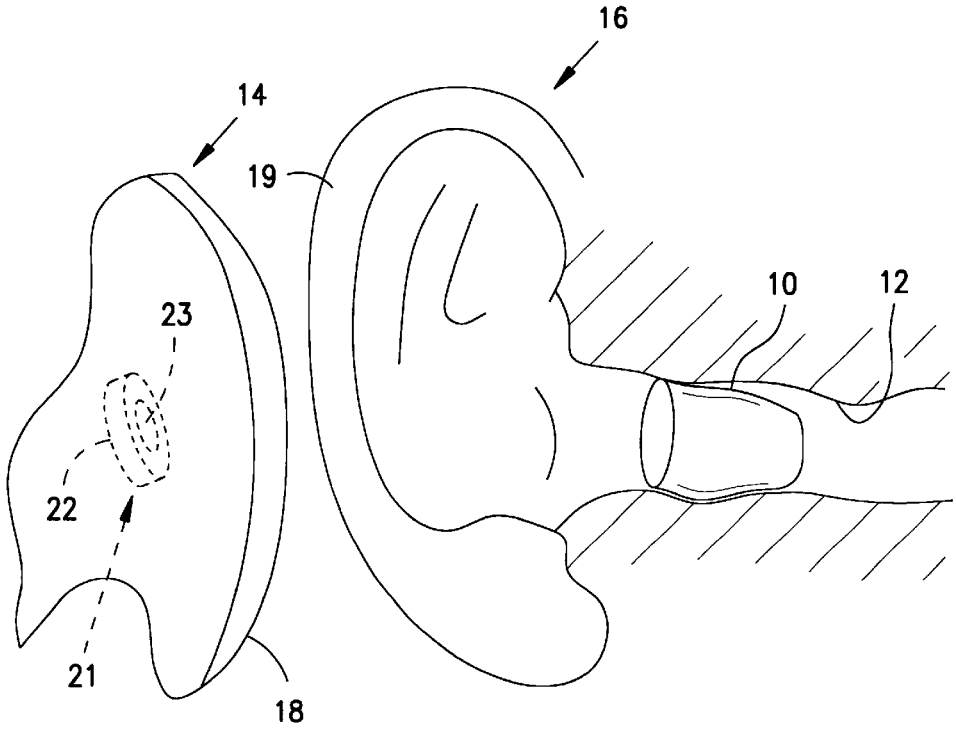
FIG. 1 illustrates the hearing aid of the present invention adjacent a telephone handset.
Figure 2:
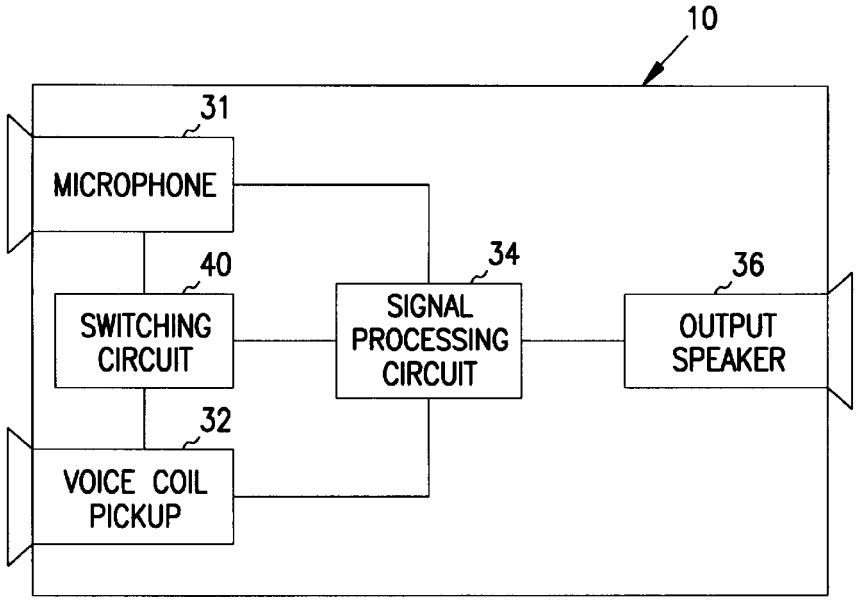
FIG. 2 is a schematic view of the FIG. 1 hearing aid.

FIG. 1 illustrates an in-the-ear hearing aid 10 which is shown positioned completely in the ear canal 12. A telephone handset 14 is positioned adjacent the ear 16 and, more particularly, the speaker 18 of the handset is adjacent the pinna 19 of ear 16. Speaker 18 includes an electromagnetic transducer 21 which includes a permanent magnet 22 and a voice coil 23 fixed to a speaker cone (not shown). Briefly, the voice coil 23 receives the time-varying component of the electrical voice signal and moves relative to the stationary magnet 22. The speaker cone moves with coil 23 and creates an audio pressure wave ("acoustic signal"). It has been found that when a person wearing a hearing aid uses a telephone it more efficient for the hearing aid 10 to pick up the voice signal from the magnetic field gradient produced by the voice coil 23 and not the acoustic signal produced by the speaker cone.

Hearing aid 10 has two inputs, a microphone 31 and a voice coil pickup 32. The microphone 31 receives acoustic signals, converts them into electrical signals and transmits same to a signal processing circuit 34. The signal processing circuit 34 provides various signal processing functions which can include noise reduction, amplification, and tone control. The signal processing circuit 31 outputs an electrical signal to an output speaker 36 which transmits audio into the wearer's ear. The voice coil pickup 32 is an electromagnetic transducer which senses the magnetic field gradient produced by movement of the telephone voice coil 23 and in turn produces a corresponding electrical signal which is transmitted to the signal processing circuit 34. Accordingly, use of the voice coil pickup 32 eliminates two of the signal conversions normally necessary when a conventional hearing aid is used with a telephone, namely, the telephone handset 14 producing an acoustic signal and the hearing aid microphone 31 converting the acoustic signal to an electrical signal. It is believed that the elimination of these signal conversions improves the sound quality that a user will hear from the hearing aid.

A switching circuit 40 is provided to switch the hearing aid input from the microphone 31, the default state, to the voice coil pickup 32, the magnetic field sensing state. It is desired to automatically switch the states of the hearing aid 10 when the telephone handset 14 is adjacent the hearing aid wearer's ear. Thereby, the need for the wearer to manually switch the input state of the hearing aid when answering a telephone call and after the call is eliminated. Finding and changing the state of the switch on a miniaturized hearing aid can be difficult especially when under the time constraints of a ringing telephone.

Figure 3:
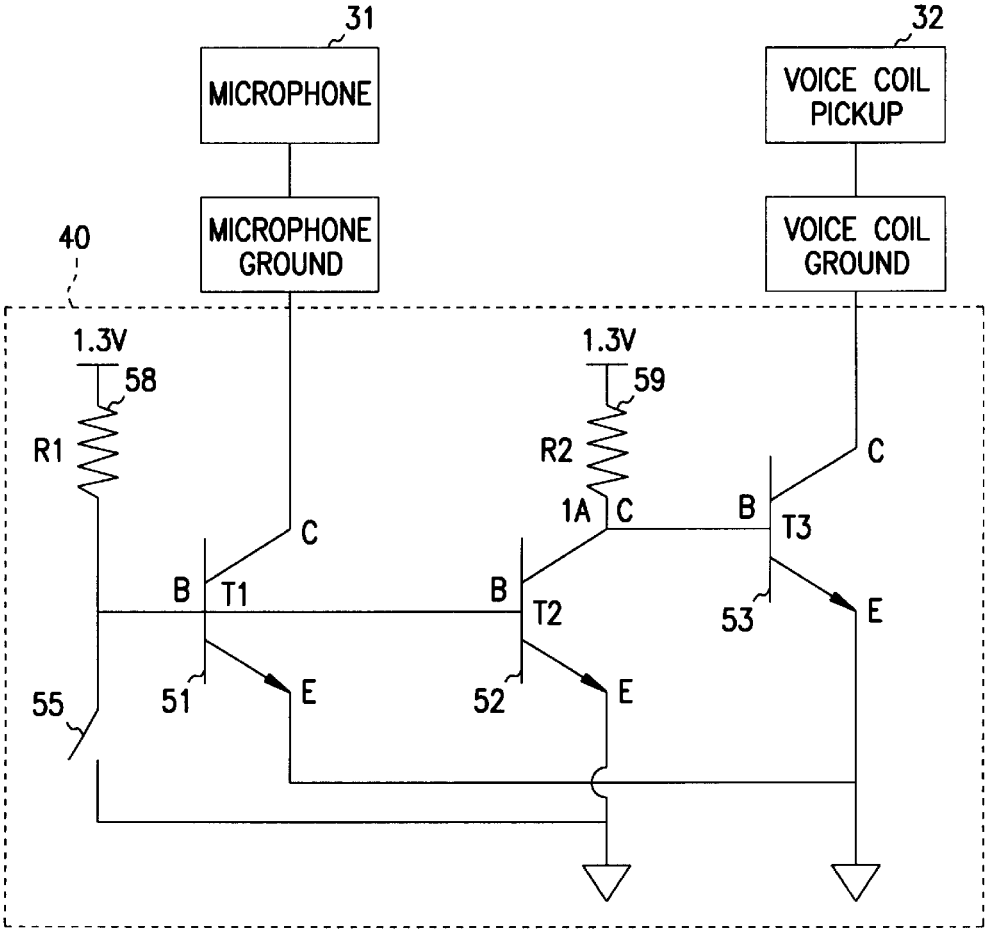
FIG. 3 shows a diagram of the switching circuit of FIG. 2.

The switching circuit 40 of the described embodiment changes state when in the presence of the telephone handset magnet 22 which produces a constant magnetic field that switches the hearing aid input from the microphone 31 to the voice coil pickup 32. As shown in FIG. 3, the switching circuit 40 includes a microphone activating first switch 51, here shown as a transistor that has its collector connected to the microphone ground, base connected to a hearing aid voltage source through a resistor 58, and emitter connected to ground. Thus, the default state of hearing aid 10 is switch 58 being on and the microphone circuit being complete. A second switch 52 is also shown as a transistor that has its collector connected to the hearing aid voltage source through a resistor 59, base connected to the hearing aid voltage source through resistor 58, and emitter connected to ground. A voice coil activating third switch 53 is also shown as a transistor that has its collector connected to the voice pick up ground, base connected to the collector of switch 52 and through resistor 59 to the hearing aid voltage source, and emitter connected to ground. A magnetically activated fourth switch 55 has one contact connected to the base of first switch 51 and through resistor 58 to the hearing aid voltage source, and the other contact is connected to ground. Contacts of switch 55 are normally open.

In this default open state of switch 55, switches 51 and 52 are conducting. Therefore, switch 51 completes the circuit connecting microphone 31 to the signal processing circuit 34. Switch 52 connects resistor 59 to ground and draws the voltage away from the base of switch 53 so that switch 53 is open and not conducting. Accordingly, hearing aid 10 is operating with microphone 31 active and the voice coil pickup 32 inactive.

Switch 55 is closed in the presence of a magnetic field, particularly in the presence of the magnetic; field produced by telephone handset magnet 22. In one embodiment of the invention, switch 55 is a reed switch, for example a microminiature reed switch, type HSR-003 manufactured by Hermetic Switch, Inc. of Chickasha, Okla. When the telephone handset magnet 22 is close enough to the hearing aid wearer's ear, the magnetic field produced by magnet 22 closes switch 55. Consequently, the base of switch 51 and the base of switch 52 are now grounded. Switches 51 and 52 stop conducting and microphone ground is no longer grounded. That is, the microphone circuit is open. Now switch 52. no longer draws the current away from the base of switch 53 and same is energized by the hearing aid voltage source through resistor 59. Switch 53 is now conducting. Switch 53 connects the voice pickup coil ground to ground and completes the circuit including the voice coil pickup 32 and signal processing circuit 34.

In usual operation, switch 55 automatically closes and conducts when it is in the presence of the magnetic field produced by telephone handset magnet 22. This eliminates the need for the hearing aid wearer to find the switch, manually change switch state, and then answer the telephone. The wearer can conveniently merely pickup the telephone handset and place it by his/her ear whereby hearing aid 10 automatically switches from receiving microphone (acoustic) input to receiving pickup coil (electromagnetic) input. Additionally, hearing aid 10 automatically switches back to microphone input after the telephone handset 14 is removed from the ear. This is not only advantageous when the telephone conversation is complete but also when the wearer needs to talk with someone present (microphone input) and then return to talk with the person on the phone (voice coil input).

While the disclosed embodiment references an in-the-ear hearing aid, it will be recognized that the inventive features of the present invention are adaptable to other styles of hearing aids including over-the-ear, behind-the-ear, eye glass mount, implants, body worn aids, etc. Due to the miniaturization of hearing aids, the present invention is advantageous to many miniaturized hearing aids.

Possible applications of the technology include, -but are not limited to, hearing aids. Those skilled in the art will readily recognize how to realize different embodiments using the novel features of the present invention. Several other embodiments, applications and realizations are possible without departing from the present invention. Consequently, the embodiment described herein is not intended in an exclusive or limiting sense, and that scope of the invention is as claimed in the following claims and their equivalents.

What is claimed is:

1. A method of hearing aid operation having first and second operational states, comprising:

in the first operational state, inputting a first signal into the hearing aid;

processing the first signal;

outputting the processed first signal;

in the second operational state, automatically switching the hearing aid, in response to the hearing aid detecting a magnetic field, by activating a magnetic switch to make a first transistor turn off a microphone circuit and a second transistor turn on a voice coil circuit to input a second signal in place of the first signal;

processing the second signal; and outputting the processed second signal.

2. The method according to claim 1, wherein detecting a magnetic field includes detecting a magnetic field imparted to the hearing aid by positioning a telephone handset adjacent the hearing aid.

3. The method according to claim 1, wherein automatic switching continues to input the second signal until the magnetic field is removed from the hearing aid.

4. The method according to claim 3, wherein detecting a magnetic field includes detecting a magnetic field imparted to the hearing aid by positioning a telephone handset adjacent the hearing aid.

5. The method according to claim 4, wherein the second signal is the electromagnetic signal generated by a coil in the telephone handset.

6. The method according to claim 5, wherein the first signal is an audio signal inputted into the hearing aid through a microphone.

7. A hearing aid system comprising a telephone handset and a hearing aid, said telephone handset having a magnet, and said hearing aid comprising:

a microphone adapted to output a first signal based on acoustic input, a voice coil pickup adapted to output a second signal based on electromagnetic input, a switching circuit having first and second transistor switches, the switching circuit connected to said microphone and said voice coil pickup, said switching circuit automatically transmitting the first signal with the first transistor switch conducting in the absence of a magnetic field produced by said magnet and automatically transmitting the second signal with the second transistor switch conducting in the presence of said magnet and with the first transistor turning off a microphone circuit that includes said microphone in the presence of said magnet;

a signal processing circuit connected to said switching circuit, said signal processing circuit receiving the signal transmitted by said switching circuit.

8. The system according to claim 7, wherein said switching circuit includes a magnetically actuated switch which in a default state closes said microphone circuit that includes said microphone and said signal processing circuit, and in its activated state closes a voice coil circuit that includes said voice coil pickup and said signal processing circuit.

9. The system according to claim 8, wherein said switching circuit only closes one of said microphone circuit and said voice coil circuit at a time.

10. The system according to claim 7, wherein the signal processing circuit is adapted to provide noise reduction and tone control.

11. A hearing aid, comprising:

a first input unit adapted to output a first signal based on a first input;

a second input unit adapted to output a second signal based on a second input;

a signal processing circuit connected to said first input unit and said second input unit; and an automatic switching circuit having a magnetic switch, a first transistor switch and a second transistor switch, the automatic switching circuit operatively connected to said first input unit by the first transistor switch and said second input unit by the second transistor switch, said automatic switching circuit having a default state wherein said first signal is received by said signal processing circuit and a switched state wherein in response to an external electromagnetic stimulus said second signal is received by said signal processing circuit, the magnetic switch controlling the first and second transistor switches to turn the first transistor switch off to turn off a circuit that includes said first input unit while turning the second transistor switch on.

12. The hearing aid according to claim 11, wherein said second input is produced by a device having the external electromagnetic stimulus.

13. The hearing aid according to claim 11, wherein the second input unit is a voice coil pickup, said external electromagnetic stimulus is a magnet in a telephone handset.

* * * * *